US005551563A

United States Patent [19]

Allen

[11] Patent Number: 5,551,563

[45] Date of Patent: Sep. 3, 1996

[54] PACKAGING UNITS FOR PACKAGING A PLURALITY OF GENERALLY CYLINDRICAL OBJECTS

[75] Inventor: Lesley M. Allen, Shelby, N.C.

[73] Assignee: PPG Industries, Inc., Pittsburgh, Pa.

[21] Appl. No.: 360,541

[22] Filed: Dec. 21, 1994

[51] Int. Cl.[6] ..... B65D 85/00

[52] U.S. Cl. ..... 206/394; 206/497; 206/499

[58] Field of Search ..... 206/391, 392, 206/393, 394, 497, 499

[56] References Cited

U.S. PATENT DOCUMENTS

| | | | |
|---|---|---|---|
| 2,570,340 | 10/1951 | George | 206/392 |
| 3,109,540 | 11/1963 | Klimpl . | |
| 3,249,412 | 5/1966 | Kolek et al. . | |
| 3,638,790 | 2/1972 | Schmid et al. . | |
| 3,835,986 | 9/1974 | LeBeau | 206/497 X |
| 3,850,294 | 11/1974 | Phillipps et al. . | |
| 3,915,301 | 10/1975 | Gray et al. . | |
| 3,954,219 | 5/1976 | Mangini et al. . | |
| 4,097,004 | 6/1978 | Reese . | |
| 4,147,253 | 4/1979 | Brook et al. . | |
| 4,201,138 | 5/1980 | Cox . | |
| 4,202,448 | 5/1980 | Jaeger et al. . | |
| 4,247,021 | 1/1981 | Renier et al. . | |
| 4,292,901 | 10/1981 | Cox | 108/55.1 |
| 4,435,479 | 5/1984 | Pivoteau et al. | 428/542.8 |
| 4,546,880 | 10/1985 | Reese | 206/410 |
| 4,595,093 | 6/1986 | Eckstein | 206/44 R |
| 4,667,823 | 5/1987 | Wolfe, Jr. et al. | 206/392 |
| 4,762,750 | 8/1988 | Girgis | 428/378 |
| 4,762,751 | 8/1988 | Girgis et al. | 428/378 |
| 4,998,619 | 3/1991 | Sowa et al. | 206/392 |
| 5,147,040 | 9/1992 | Koike et al. | 206/410 |
| 5,344,014 | 9/1994 | Toral et al. | 206/394 |

OTHER PUBLICATIONS

"The Manufacturing Technology of Continuous Glass Fibres", K. L. Loewenstein, 2 Ed. 1983, pp. 15–29, 33–39, 243–295,297–339.

PPG Industries, Inc. Packing Specification No. 913.0; five photos, Exhibit B.

PPG Industries, Inc., four photos of packaging unit shown commercially about Sep. 1992.

PPG Industries, Inc. Packing Specification No. 654.2 dated Apr. 13, 1993.

PPG Industries, Inc. Packing Specification No. 972.1 dated Dec. 3, 1992.

PPG Industries, Inc. Packing Specification No. 972.0 dated Nov. 19, 1992.

Report dated Jul. 9, 1993 from Paul E. Sowa of Signode Packaging Systems regarding alternative packaging units.

Exhibit A—three photos of prior art packaging unit.

ASTM Chapter 19, "Testing IV—Methods for Combined Board; Structural Characteristics".

*Primary Examiner*—Jacob K. Ackun
*Attorney, Agent, or Firm*—Ann Marie Odorski

[57] ABSTRACT

The present invention includes packaging units which include a generally rigid support base having a bottom wall having edges, side walls and corners. Each side wall extends upwardly from an edge and each corner extends upwardly from an intersection of two edges. Generally cylindrical objects are arranged in an assembly on the support base in at least one vertical column or horizontal row. Each object has a top end, bottom end and side extending therebetween, a portion of which can contact the support base. The assembly is free of walls between the objects of the assembly. A generally rigid lid has a top wall, edges and corners. Each edge of the lid has a side wall extending downwardly therefrom and each corner extends downwardly from an intersection of two edges. Each corner of the support base is adjacent to or connected to a corresponding corner of the lid or by corner protectors extending between the corresponding corners of the support 14 base and lid. Each side wall of the support base is spaced apart from each corresponding side wall of the lid. A retainer means extends around the support base, assembly of cylindrical objects and lid to maintain the integrity of the packaging unit during movement thereof.

29 Claims, 3 Drawing Sheets

PACKAGING UNITS FOR PACKAGING A PLURALITY OF GENERALLY CYLINDRICAL OBJECTS

FIELD OF THE INVENTION

The present invention relates to packaging units for packaging a plurality of generally cylindrical objects and, more specifically, to recyclable packaging units for packaging a plurality of wound packages which require less packaging material than conventional packaging units.

BACKGROUND OF THE INVENTION

Storage and transportation of cylindrical objects or packages, such as rolls of sheet material or wound packages of strand material, is a problem which faces many industries, such as the textile, paper products and fiber glass industries. These cylindrical packages are typically stored and shipped in vertically and horizontally stacked arrangements. During handling or shipping, these packages can shift position and contact each other and external objects. This contact can damage the packages, particularly wound packages of a generally brittle strand material such as fiber glass. Numerous packaging systems, such as those disclosed in the patents discussed below, have attempted to resolve this problem.

U.S. Pat. No. 3,109,540 discloses a textile shipping package having horizontal and vertical separators between individual roving balls contained therein. The strand material of each roving ball has a leading end and a trailing end. The trailing end of each of roving ball is connected to the leading end of the roving ball thereunder. The trailing end of the bottom roving ball in a column is connected to the leading end of the roving ball at the top of an adjacent column to permit automatic transfer between roving balls during withdrawal of the strand material from the shipping package.

U.S. Pat. No. 4,998,619 discloses a shipping package system having tiers of vertically stacked rolls with pads between the tiers. Corner guards conforming to the surface of each corner roll extend between the pads. Generally rectangular corners are positioned at each corner of the package system.

U.S. Pat. Nos. 4,201,138 and 4,292,901 disclose cornerboards for a pallet having a load of rectangular stacked boxes thereon. The cornerboards consist of two boards fastened together at a right angle to each other. The cornerboards can include top cap members having a top cover and right angled side menders extending downwardly therefrom. The side members of the cap members include slots for receiving the cornerboards.

It is desirable not only to provide stability to the arrangement of packages, but to minimize the amount of packaging material and utilize recyclable materials.

SUMMARY OF THE INVENTION

One aspect of the present invention is a packaging unit comprising a generally rigid support base. The support base comprises a bottom wall having a plurality of edges, a plurality of side walls and a plurality of corners. Each side wall extends upwardly from an edge. Each corner extends upwardly from an intersection of two edges. The packaging unit also comprises a plurality of generally cylindrical objects arranged in an assembly having at least one vertical column. Each vertical column comprises a bottom object and a top object. Each object has a top end, a bottom end and a side extending therebetween. The bottom end of each bottom object is supported by the support base. A portion of the side of selected bottom objects are adjacent to a portion of the support base selected from the group consisting of at least one of the side walls of the support base, at least one of the corners of the support base, and combinations thereof. The assembly is free of walls between the cylindrical objects of the assembly. The packaging unit additionally comprises a generally rigid lid comprising a top wall having a lower side, an upper side opposite the lower side, a plurality of edges, and a plurality of corners. Each side wall extends downwardly from a corresponding edge of the top wall. Each corner extends downwardly from an intersection of two edges. A portion of each corner of the support base is adjacent to a portion of a corresponding corner of the lid. The lower side of the lid is adjacent to the top end of each top object. A portion of the side of selected top objects are adjacent to a portion of the lid selected from the group consisting of at least one of the side walls of the lid, at least one of the corners of the lid and combinations thereof. Each side wall of the support base is spaced apart from each corresponding side wall of the lid. The packaging unit also comprises a retainer means extending around the support base, assembly of cylindrical objects and lid to maintain the integrity of the packaging unit during movement of the packaging unit.

In another aspect of the present invention, each corner of the support base has an inner side and an outer side. Each corner of the lid also has an inner side and an outer side. The packaging unit also comprises a plurality of generally rigid corner protectors extending between each corner of the support base and each corresponding corner of the lid. Each corner protector has an inner side, an outer side, a top end and a bottom end. The outer side of the bottom end of each corner protector is adjacent to the inner side of the corresponding corner of the support base. The outer side of the top end of each corner protector is adjacent to the inner side of the corresponding corner of the lid. Each corner protector is adjacent to at least one of the vertical columns of objects.

In yet another aspect of the present invention, each corner protector has a bottom end and a top end. The bottom end of each corner protector is connected to the corresponding corner of the support base. The top end of each corner protector is connected to the corresponding corner of the lid. Each corner protector is adjacent to at least one of the vertical columns of objects.

In another aspect of the present invention, the packaging unit comprises a generally rigid support base. The support base comprises a bottom wall having a plurality of edges, a plurality of side walls and a plurality of corners. Each side wall extends upwardly from an edge. Each corner extends upwardly from an intersection of two edges. The packaging unit also comprises a plurality of generally cylindrical objects arranged in an assembly having at least one horizontal row having at least one bottom object. Each object has a top end, a bottom end and a side extending therebetween. The bottom end of each bottom object is supported by the support base. A portion of the side of selected bottom objects are adjacent to a portion of the support base selected from the group consisting of at least one of the side walls of the support base, at least one of the corners of the support base, and combinations thereof. The assembly is free of walls between the cylindrical objects of the assembly. The packaging unit additionally comprises a generally rigid lid comprising a top wall having a lower side, an upper side opposite the lower side, a plurality of edges, and a plurality of corners. Each side wall extends downwardly from a corresponding edge of the top wall. Each corner extends downwardly from an intersection of two edges. A portion of each corner of the support base is adjacent to a portion of a corresponding corner of the lid. The lower side of the lid is adjacent to the top end of selected objects. A portion of the side of the selected objects are adjacent to a portion of the lid selected from the group consisting of at least one of the side walls of the lid, at least one of the corners of the lid and combinations thereof. Each side wall of the support base is spaced apart from each corresponding side wall of the lid. The packaging unit also comprises a retainer means extending around the support base, assembly of cylindrical objects and lid to maintain the integrity of the packaging unit during movement of the packaging unit.

Yet another aspect of the present invention is the above packaging unit having at least one horizontal row which further comprises a plurality of generally rigid corner protectors extending between each corner of the support base and each corresponding corner of the lid. Each corner protector has an inner side, an outer side, a top end and a bottom end. The outer side of the bottom end of each corner protector is adjacent to the inner side of the corresponding corner of the support base. The outer side of the top end of each corner protector is adjacent to the inner side of the corresponding corner of the lid. Each corner protector is adjacent to at least one object of the horizontal row.

BRIEF DESCRIPTION OF THE DRAWINGS

The foregoing summary, as well as the following detailed description of the preferred embodiment, will be better understood when read in conjunction with the appended drawings. For the purpose of illustrating the invention, there are shown in the drawings an embodiment which is presently preferred and alternative embodiments, it being understood, however, that the invention is not limited to the specific arrangements, methods and instrumentalities disclosed. In the drawings.

DETAILED DESCRIPTION OF THE PREFERRED EMBODIMENT

The packaging units and systems of the present invention provide stability to arrangements of generally cylindrical objects using less packaging materials than conventional packaging systems. Also, packaging materials can be selected for the packaging unit which are recyclable, thereby benefiting the ecology and reducing cost.

Figure 1:
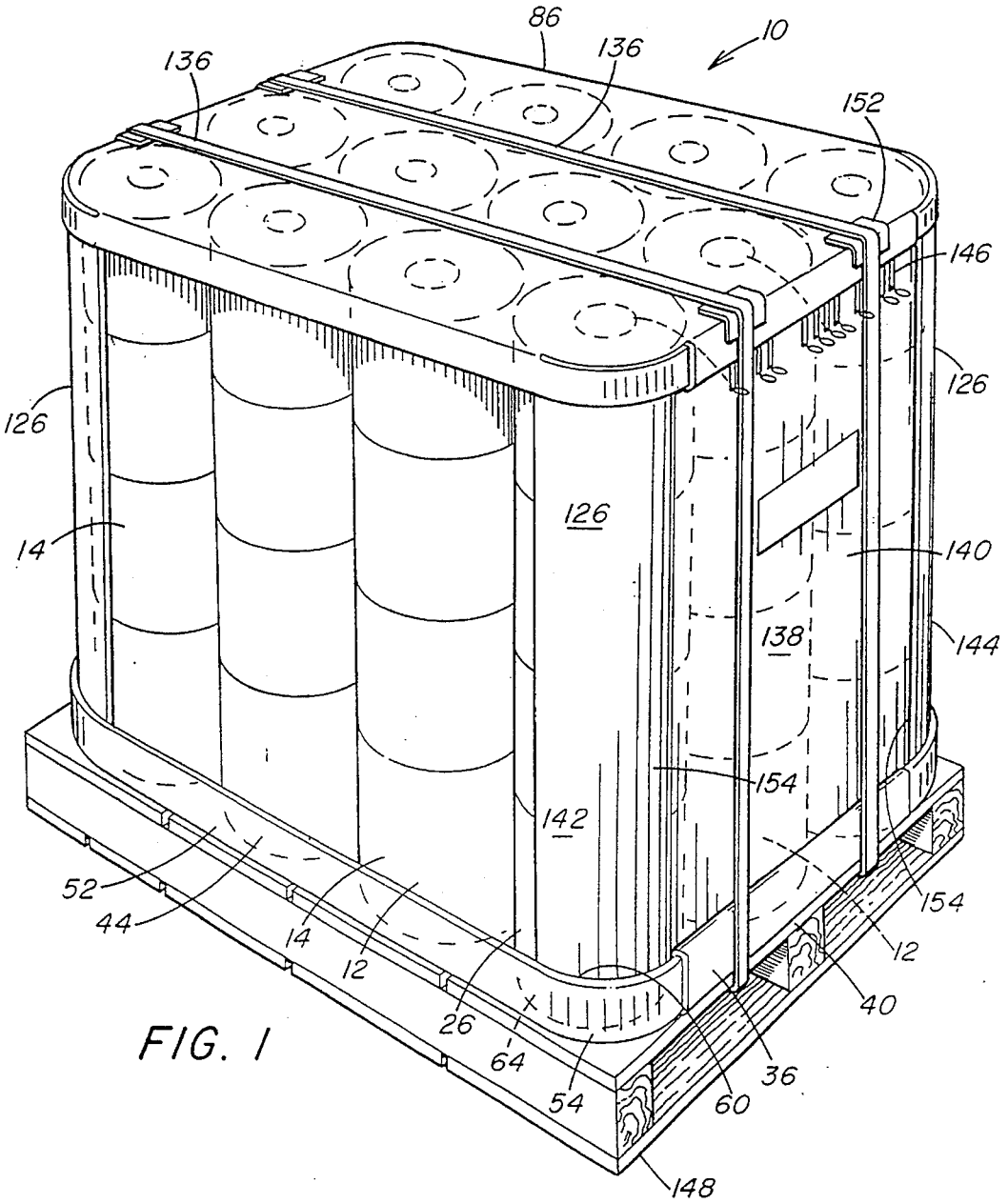
FIG. 1 is a perspective view of a preferred packaging unit in accordance with the present invention.

Referring to the drawings, wherein like numerals indicate like elements throughout, there is shown in FIG. 1 a preferred embodiment of an packaging unit, generally designated 10, for packaging a plurality of generally cylindrical objects 12, in accordance with the present invention.

Non-limiting examples of generally cylindrical objects 12 which can be packaged using the packaging units of the present invention include cylinders; canisters; and/or rolls of sheet material or wound packages of strand or yarn material such as textiles, paper products and fiber glass strands, mats or cloths. The present invention will now be discussed generally in the context of its use in packaging wound roving packages 14 of glass fiber strands 16. However, one of ordinary skill in the art would understand that the present invention is useful for packaging any of the wound materials or sheet materials discussed above.

Figures 2, 3:
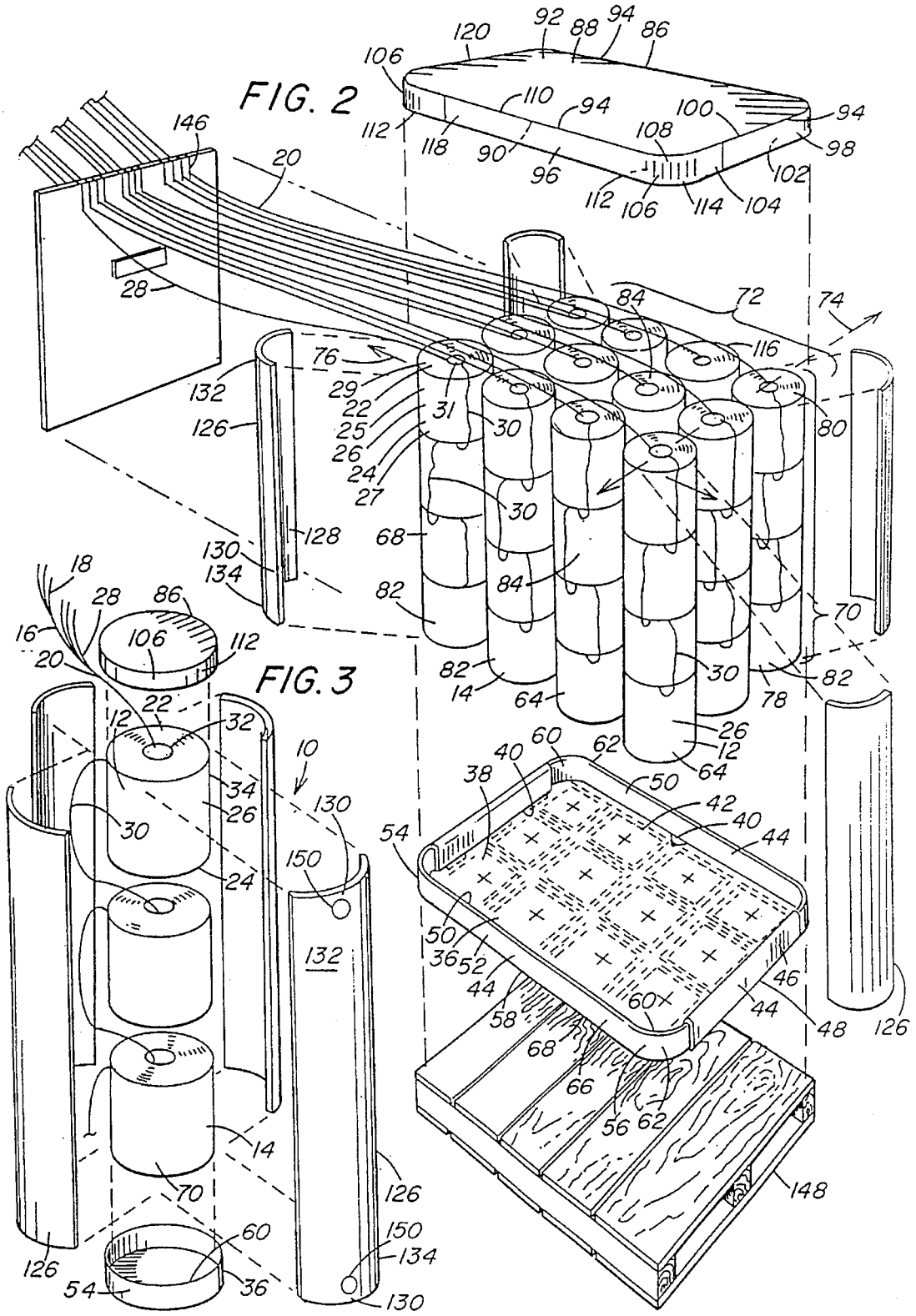
FIG. 2 is an exploded view of the packaging unit of FIG. 1, taken along lines 1–1 of FIG. 1.
FIG. 3 is an exploded view of an alternative embodiment of a packaging unit in accordance with the present invention.

The term "strand" or "strands" 16 as used herein refers to a plurality of fibers 18 or filaments, as shown in FIG. 3. Suitable glass fibers include those prepared from fiberizable glass compositions such as "E-glass", "621-glass", "A-glass", "C-glass", "S-glass", and fluorine and/or boron-free derivatives thereof. Examples of such glass fiber compositions are well known to those of ordinary skill in the art and are disclosed in K. Loewenstein, *The Manufacturing Technology of Continuous Glass Fibres* at pages 33–39 (2d Ed. New York 1983), which is hereby incorporated by reference.

The fibers 18 are typically coated with a coating or sizing composition during the forming process to protect the glass fibers 18 from interfilament abrasion. Typical sizing compositions include as components film-formers such as starch and/or thermoplastic or thermosetting polymeric film-formers and mixtures thereof, lubricants such as animal, vegetable or mineral oils or waxes, coupling agents, emulsifiers, antioxidants, ultraviolet light stabilizers, colorants, antistatic agents and water, to name a few. Suitable sizing compositions are well known to those of ordinary skill in the art, non-limiting examples of which are set forth in Loewenstein at pages 243–295 and U.S. Pat. No. 3,249,412, each of which is hereby incorporated by reference.

A plurality of glass fibers 18 is generally gathered into a strand 16, or end, and wound to form a forming package (not shown). The forming packages can be dried, for example, in an oven to reduce the water content and cure any curable components of the sizing composition. A plurality of strands 16 can be combined in parallel form to form a bundle or roving 20. Typical rovings 20 useful in the present invention are discussed in Loewenstein at page 20, which is hereby incorporated by reference. The roving 20 can be coated with a conventional secondary coating or impregnating composition, such as are disclosed in Loewenstein at pages 252–254 and U.S. Pat. Nos. 4,762,750 and 4,762,751, each of which is hereby incorporated by reference.

Roving 20 is typically wound about a removable tubular support (not shown) mounted on a winding device (not shown) to form a wound or roving package 14. The details of the processes for forming glass fibers and preparing forming and roving packages, cloths and mats of the same are not believed to be necessary to an understanding of the present invention as one skilled in the art is knowledgeable concerning these details. Further details are disclosed in Loewenstein at pages 15–29 and 297–339, which is hereby incorporated by reference.

Referring now to FIG. 2, each roving package 14 has a top end 22, a bottom end 24 and a side 26 extending therebetween. The tubular support is preferably removed from the roving package 14 prior to positioning the hollow roving package 14 in the packaging unit 10. The roving 20 has a leading end 28 and a trailing end 30. As shown in FIG. 3, the roving packages 14 are preferably wound such that the leading end 28 of the roving 20 is located at the interior 32 and the trailing end 30 at the exterior 34 of each roving package 14.

Each roving package 14 is typically cylindrically-shaped and has a hollow center which permits withdrawal of the roving 20 from the inside of the roving package 14. The dimensions of the roving packages 14 can vary, depending upon such variables as the diameter and type of fiber strand wound thereon, and are generally determined by convenience for later handling and processing. Generally, roving packages 14 are about 6 to about 20 inches in diameter and have a length of about 2 to about 30 inches. Loewenstein discloses at page 20 that a typical roving package can consist of 30 strands, weigh up to 20 kilograms, and have a cylindrical shape of 300 millimeters (mm) in diameter and 250 mm in height. The size of the objects 12 can be any size which is practical for permitting movement of the packaging unit 10.

As shown in FIG. 2, the roving packages 14 can have a protective material, such as a sleeve, wrapped about at least a portion 25 of the side 26 of the packages 14. As presently preferred, the protective material is a bag 27 which protects at least a portion of the side 26 and bottom end 24 of the package 14. The bag 27 can be folded or include a removable closure means or tie at the top 29 to prevent dirt and foreign matter from contacting the roving 20.

The leading end 28 and trailing end 30 of the roving 20 can be routed through the opening 31 at the top 29 of the bag 27, permitting the trailing end 30 of a package 14 to be attached or tied to the leading end 28 of an adjacent package 4. By attaching the trailing end 30 of a package 14 to the leading end 28 of an adjacent package 14, automatic transfer between the packages 14 is permitted during withdrawal of the roving 20 from the packaging unit 10. For purposes of clarity in the drawing, the bag 27 has been omitted in FIG. 3. This omission is not intended to limit the scope of the present invention.

As shown in FIG. 2, the packaging unit 10 comprises a generally rigid support base 36. The support base 36 comprises a bottom wall 38 having a plurality of edges 40. The bottom wall 38 is preferably generally planar, however the bottom wall 38 can include, for example, perforations 42 (shown in FIG. 3), striations, ridges, undulations, apertures and/or protrusions to inhibit movement of the roving packages 14 adjacent thereto. In FIG. 2, the bottom wall 38 is shown in its preferred configuration, namely generally rectangular having four edges 40. The bottom wall 38 can have two, three or as many edges 40 as desired. The edges 40 are preferably linear, but can include curvatures, notches or protrusions, for example.

Referring to FIG. 2, the support base 36 also comprises a plurality of side walls 44. Each of the side walls 44 extends upwardly from a corresponding edge 40 of the support base 36. For example, side wall 46 extends upwardly from edge 48. As presently preferred, each of the side walls 44 is generally perpendicular to the bottom wall 38 of the support base 36. One skilled in the art would understand, however, that the side walls 46 can extend from the corresponding edge 40 at an acute or oblique angle to the bottom wall 38, as desired.

Each of the side walls 44 is preferably generally planar, although any or all of the side walls 44 can be curved or include perforations, striations, ridges, undulations, apertures and/or protrusions. Each of the side walls 44 includes an inner side 50 and an outer side 52. The inner side 50 of each of the side walls 44 is adjacent to and preferably contacts at least one of the roving packages 14 to retain the roving packages 14 within the packaging unit 10 and inhibit movement or shifting of the roving packages 14 during movement of the packaging unit 10.

The support base 36 also comprises a plurality of corners 54. Each of the corners 54 extends upwardly from an intersection of two edges 40. For example, corner 56 extends upwardly from the region of the intersection of edge 48 and edge 58. As presently preferred, each of the corners 54 is generally perpendicular to the bottom wall 38 of the support base 36, however, the corners 54 can extend from the corresponding edges 40 at an acute or oblique angle to the bottom wall 38.

As shown in FIG. 2, each of the corners 54 has an inner side 60 and an outer side 62. The inner side 60 of each of the corners 54 is adjacent to and preferably contacts at least one of the roving packages 14 to retain the roving packages 14 within the packaging unit 10 and inhibit movement or shifting of the roving packages 14 during movement of the packaging unit 10.

The inner side 60 of each of the corners 54, therefore, is preferably generally arcuate about the corresponding contacting portion 64 of the side 26 of adjacent roving packages 14. The arc of the corners 54 is preferably about 90°, although the arc can be less or more than 90° depending upon such factors as the configuration of the periphery and size of the roving package 14.

Alternatively, any or all of the corners 54 can be formed from two generally planar sides intersecting at an acute, oblique or 90° angle. The inner sides 60 and/or outer sides 62 of the corners 54 can include perforations, striations, ridges, undulations, apertures and/or protrusions.

As presently preferred, the side walls 44 and corners 54 of the support base 36 form a rim 66, shown in FIG. 2, around the periphery 68 of the support base 36. The rim 66 provides added integrity and rigidity to the support base 36, inhibits shifting of the roving packages 14 during movement of the packaging unit 10 and inhibits dirt and foreign matter from entering the packaging unit 10.

The components of the support base 36 can be formed of one or more pieces of generally rigid material, such as corrugated cardboard, plastic or metal, and fastened together, for example by adhesives or fasteners. Recyclable materials, including paper products such as corrugated cardboard, thermoplastic materials such as high or low density polyethylene or polypropylene, and metals such as aluminum are useful.

Figure 5:
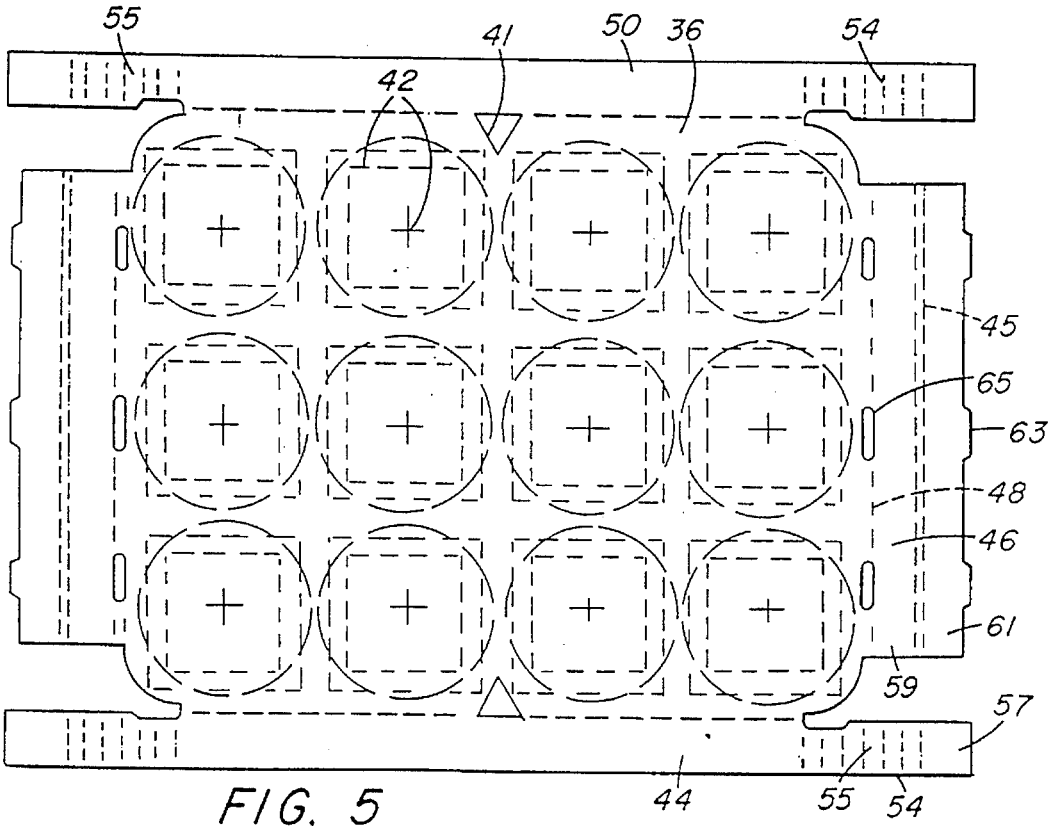
FIG. 5 is a plan view of an unfolded support base or lid of FIG. 1.

As shown in the presently preferred embodiment of FIGS. 2 and 5, the support base 36 can be formed as a single piece of generally rigid cardboard. The cardboard is preferably corrugated and can have a strength of about 200 to about 600 pounds board test, and preferably about 275 pounds board test, as determined by the Mullen test (Interstate Commerce Commission Rules 41 and 222). The thickness of the cardboard can be about 0.15 inches (3.8 mm) to about 0.3 inches (7.6 mm), and is preferably about 0.185 inches (4.7 mm), and can vary based upon such factors as the rigidity of the material and the weight of the material.

Generally, the support base 36 can be about 10 inches (25.4 cm) to about 100 inches (254 cm) wide and about 10 inches (25.4 cm) to about 100 inches (254 cm) long. The preferred support base 36 is about 38 inches (96.5 cm) wide and about 52 inches (132 cm) long for the assembly shown in FIG. 1, although these dimensions can vary based upon such factors as the number of bottom packages 78 and diameter of the bottom packages, to name a few. For example, for an assembly having 4 bottom packages by 4 bottom packages, the support base can be about 45 inches (114 cm) by about 45 inches (114 cm). The bottom wall 38 of the support base 36 can have perforations 42 or apertures 41 to inhibit sliding movement of the bottom packages 78 during movement or shipping of the packaging unit 10.

The side walls 44 are formed by folding the cardboard along fold lines 45 towards the center of the support base 36. The corners 54 are formed by folding the cardboard along fold lines 55 in an arc. The corners 54 include tabs 57 which are inserted between faces 59, 61 of folded side walls 46. Side walls 46 include at least one and preferably a plurality of tabs 63 which are inserted into corresponding apertures 65 which retain the tabs 63 and secure the side walls 46 in a folded position (shown in FIGS. 1 and 2). By forming the support base 36 of a single sheet of material, efficiency can be increased and waste can be minimized.

Alternatively, the side walls 46 can be formed of a single layer of cardboard as are side walls 44 and the corners 54 can be secured thereto by any conventional securing means, such as adhesive or staples, for example. Also, the side walls 44 can be formed of a different material than the bottom wall 38 and secured thereto by any of the conventional securing means discussed above. The support base 36 can also be formed by a variety of other methods which would be evident to one of ordinary skill in tile art in view of the present disclosure.

The height of each side wall 44 can be the same or different, and is typically about 2 inches (5.1 cm) to about 10 inches (25.4 cm), and is preferably about 3 inches (7.6 cm) to about 6 inches (15.2 cm). The width of the side walls 44 can be about 0.15 inches (3.8 mm) to about 0.6 inches (15.2 cm), although this width can vary based upon the strength of the material from which the side walls 44 are formed, the weight and height of the packages 14, to name a few factors.

Referring to FIG. 2, the packaging unit 10 also comprises a plurality of the generally cylindrical objects 12 or roving packages 14 arranged in an assembly 68. The assembly 68 has at least one vertical column 70. Each vertical column 70 can have as few as one or as many packages 14 as desired, although each of the columns 70 preferably has a bottom object or package 78 and a top object or package 80. The number of packages 14 in the columns 70 of the preferred embodiment shown in FIG. 1 is four. Factors such as the diameter and height of the packages 14, as well as the package weight, can influence the desired and practical number of packages 14 in a column 70.

Also, the number of packages 14 in different columns 70 of the assembly 68 can be different from column to column. However, to enhance the integrity of the packaging unit 10 it is preferred that each of the packages 14 in a column 70 be of the same configuration, i.e., height and diameter, and that the same number of packages 14 be included in each column 70.

Figure 4:
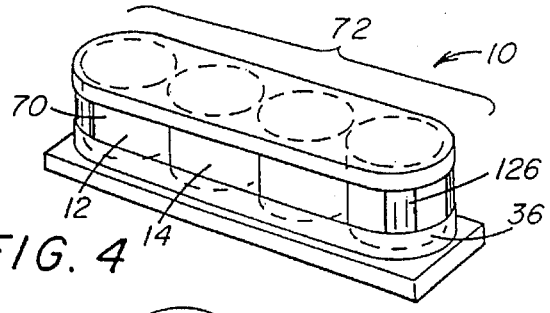
FIG. 4 is a perspective view of another alternative embodiment of a packaging unit in accordance with the present invention.

The assembly 68 can have one or a plurality of vertical columns 70. The preferred embodiment shown in FIGS. 1 and 2 has twelve columns 70 arranged in a 3×4 array. The columns may be arranged in any array desired, for example a 2×3 array or a 1×3 array. The alternative embodiment shown in FIG. 4 has only a single column The number of roving packages 14 in a column 70 can be as few as one or as many as is practical to provide stability and integrity to the assembly 68 and packaging unit 10. For example, as shown in FIG. 2, each of the columns 70 has four roving packages 14. In the alternative embodiment shown in FIG. 4, the single column 70 has three roving packages 14. In yet another alternative embodiment shown in FIG. 5, the column 70 has only a single roving package 14. Factors which can determine the number of roving packages 14 in a column 70 include such factors as the height, diameter, and weight of the roving packages 14.

Alternatively or additionally, the assembly 68 can include at least one horizontal row 72. In the presently preferred embodiment shown in FIG. 1, there are three rows along the arbitrarily chosen X axis 74 and four rows along the arbitrarily chosen Y axis 76. In the alternative embodiment shown in FIG. 5, only a single row 72 is present. One of ordinary skill in the art would understand that the number of rows 72 can be as many or as few as desired and can depend upon such factors as the diameter and weight of each roving package 14. The columns 70 may be offset such that the rows 72 are staggered.

The bottom end 24 of each bottom object or package 78 is supported by the support base 36. While it is preferred that the bottom end 24 of each bottom package 78 rest directly upon the support base 36, it is understood that an alternate support (not shown) or spacer can be supported by the support base 36 and in turn support the bottom end 24 of the bottom object 78. Such a situation may occur when the assembly 68 is missing one or more packages 14 necessary to complete the assembly 68. The spacer merely occupies roughly the same volume as the missing roving package 14.

A portion 64 of the side 26 of selected bottom objects 82 contacts a portion of the support base 36 selected from the group consisting of at least one of the side walls 44 of the support base 36, at least one of the corners 54 of the support base 36 and combinations thereof. Objects 84 other than the selected bottom objects 82 are free from contact with the portion of the support base 36. For example, such other objects 84 can be interior objects of the assembly 68 or objects other than the bottom packages 78.

A distinct advantage of the present packaging unit 10 is that the assembly 68 is free of walls between the cylindrical objects 12 or roving packages 14 of the assembly 68. As used herein, the phrase "free of walls" is defined to mean free of generally rigid, generally horizontal or vertical dividers or separators, such as are shown, for example, in U.S. Pat. No. 3,109,540 and discussed at col. 3, lines 33–37, which is hereby incorporated by reference. The packaging unit 10 of the present invention, therefore, requires less packaging material and weighs less than conventional packaging units and shipping packages such as are disclosed in U.S. Pat. Nos. 3,109,540 and 4,998,619, for example.

Referring to FIG. 2, the packaging unit 10 also comprises a generally rigid lid 86. The lid 86 comprises a top wall 88 having a lower side 90, an upper side 92 opposite the lower side 90 and a plurality of edges 94. The top wall 88 is preferably generally planar, however, the top wall 88 can include, for example, perforations, striations, ridges, undulations, apertures and/or protrusions. In FIG. 2, the top wall 88 is shown in its preferred configuration, namely generally rectangular having four edges 94. The top wall 88 can have two, three or as many edges 94 as desired. The edges 94 are preferably linear, but can include notches, curvatures or protrusions, for example.

As shown in FIG. 2, the lid 86 also comprises a plurality of side walls 96. Each of the side walls 96 extends downwardly from a corresponding edge 94 of the lid 86. For example, side wall 98 extends downwardly from edge 100. As presently preferred, each of the side walls 96 is generally perpendicular to the top wall 88 of the lid 86. One of ordinary skill in the art would understand, however, that the side walls 96 can extend from the corresponding edges 94 at an acute or oblique angle to the top wall 88, as desired.

Each of the side walls 96 is preferably generally planar, although any or all of the side walls 96 can be curved or include striations, perforations, ridges, undulations, apertures and/or protrusions, for example. Each of the side walls 96 includes an inner side 102 and an outer side 104. The inner side 102 of each of the side walls 96 is adjacent to and preferably contacts at least one of the roving packages 14 to retain the roving packages 14 within the packaging unit 10 and inhibit movement or shifting of the roving packages 14 during movement of the packaging unit 10.

The lid 86 also comprises a plurality of corners 106. Each of the corners 106 extends downwardly from an intersection of two edges 94. For example, corner 108 extends downwardly from the region of the intersection of edge 100 and edge 110. As presently preferred, each of the corners 106 is generally perpendicular to the top wall 88 of the lid 86, however, the corners 106 can extend from the corresponding edges 94 at an acute or oblique angle to the top wall 88.

As shown in FIG. 2, each of the corners 106 has an inner side 112 and an outer side 114. The inner side 112 of each of the corners 106 is adjacent to and preferably contacts at least one of the roving packages 14 to retain the roving packages 14 within the packaging unit 10 and inhibit shifting or movement of the roving packages during movement of the packaging unit 10.

The inner side 112 of each of the corners 106, therefore, is preferably generally arcuate about the corresponding contacting portion 116 of the side 26 of adjacent roving packages 14. The arc of the corners 106 is preferably about 90°, although the arc can be less or more than 90° depending upon such factors as the configuration of the periphery and size of the roving package 14.

Alternatively, any or all of the corners 106 can be formed from two generally planar sides intersecting at an acute, oblique or 90° angle. The inner side 112 and/or outer side 114 of the corners 106 can include striations, perforations, ridges, undulations, apertures and/or protrusions, as desired.

As presently preferred, the side walls 96 and corners 108 of the lid 86 form a rim 118 around the periphery 120 of the lid 86. The rim 118 provides added integrity and rigidity to the lid 86, inhibits shifting of the roving packages 14 during movement of the packaging unit 10 and inhibits dirt and foreign matter from entering the packaging unit 10.

The components of the lid 86 can be formed from the same or different material from the support base 36. Preferably, the lid 86 is substantially identical in size, dimensions and material to the support base 36 as described above, except the lid 86 is inverted. The lid 86 can also include perforations 42 such as those shown in FIG. 5 for the support base 36. These perforations inhibit sliding movement of the top packages 80 during movement or shipping of the packaging unit 10.

Figure 6:
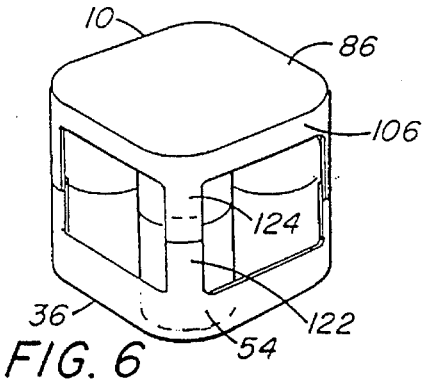
FIG. 6 is a perspective view of yet another alternative embodiment of a packaging unit in accordance with the present invention.
Figure 7:
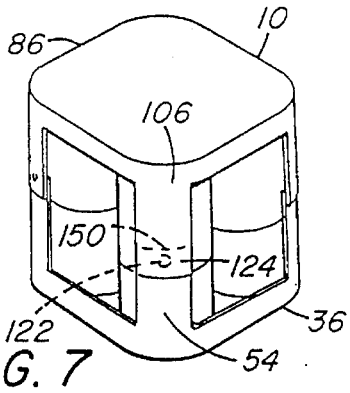
FIG. 7 is a perspective view of still another alternative embodiment of a packaging unit in accordance with the present invention.

In an alternative embodiment shown in FIG. 6, a portion 122 of each corner 54 of the support base 36 is adjacent to and preferably overlaps a portion 124 of a corresponding corner 106 of the lid 86. In another alternative embodiment shown in FIG. 7, the portion 122 of the corner 54 of the support base 36 is connected to the portion 124 of the corresponding corner 106 of the lid 86 by a connecting means or adhesive 150. The portions 122, 124 can be connected by any conventional connecting or fastening means well known to those of ordinary skill in the art, such as adhesive, tape or staples, for example.

In the presently preferred embodiment shown in FIGS. 1 and 2, the packaging unit 10 also comprises a plurality of generally rigid corner protectors 126. Each corner protector 126 extends between a corner 54 of the support base 36 and a corresponding corner 106 of the lid 86. Each corner protector 126 has an inner side 128, an outer side 130, a top end 132 and a bottom end 134. The outer side 130 of the bottom end 134 of each corner protector 126 is adjacent to the inner side 60 of the corresponding corner 54 of the support base 36. As presently preferred, the outer side 130 of the bottom end 134 of each corner protector 126 is in facing engagement with the inner side 60 of the corresponding corner 54 of the support base 36. In the alternative embodiment shown in FIG. 3, the outer side 130 of the bottom end 134 of each corner protector 126 is connected to the inner side 60 of the corresponding corner 54 of the support base 36. The corner protector 126 can be connected to the corner 54 of the support base 36 by any conventional securing means, such as adhesive 150, tape or staples, for example.

Similarly, the outer side 130 of the top end 132 of each corner protector 126 is adjacent to the inner side 112 of the corresponding corner 106 of the lid 86. In the preferred embodiment shown in FIG. 1, the outer side 130 of the top end 132 of each corner protector 126 is in facing engagement with the inner side 112 of the corresponding corner 106 of the lid 86. In the alternative embodiment shown in FIG. 3, the outer side 130 of the top end 132 is connected to the inner side 112 of the corresponding corner 106 by any conventional securing means, such as adhesive 150 or staples, for example.

As shown in FIG. 1, each corner protector 126 is adjacent to and preferably in facing engagement with at least one of the vertical columns 70 of objects 12 or roving packages 14.

Figure 8:
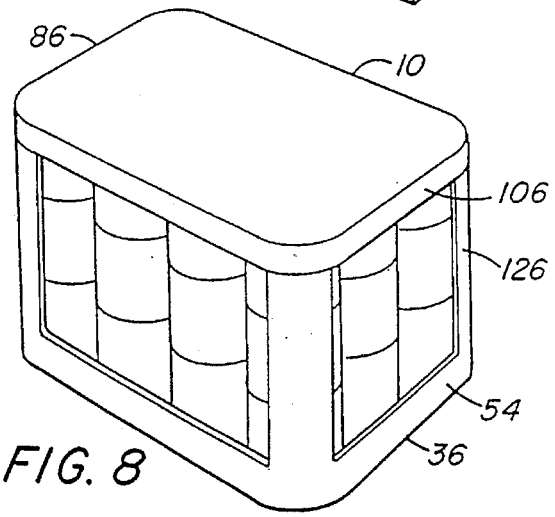
FIG. 8 is a perspective view of another alternative embodiment of a packaging unit in accordance with the present invention.

In the alternative embodiment shown in FIG. 8, the packaging unit 10 includes a plurality of generally rigid corner protectors 126 which extend between each corner 54 of the support base 36 and each corresponding corner 106 of the lid.

Preferably, the corner protectors 126 are formed from one or more layers of a rigid material such as cardboard, corrugated cardboard, metal, plastic or any other rigid and preferably recyclable material well known to those of ordinary skill in the art. As presently preferred, the corner protectors 126 are formed from cardboard free of corrugations, although they could be formed from corrugated cardboard.

The corner protectors can generally be about 10 inches (25.4 cm) to about 60 inches (152.4 cm) long, about 0.1 inches (2.5 mm) to about 0.75 inches (19.1 mm) thick, about 5 to about 20 inches in width along the arc and have an arc of about 60 to about 120 degrees. Preferably the arc is about 90 degrees. The preferred corner protectors are about 41¼ inches (104.8 cm) long, about 0.350 inches (8.9 mm) thick, and about 9 inches (22.9 cm) in width along the arc for a column of four roving packages about 40 inches high. The foregoing examples of dimensions of the corner protectors are not intended to limit the scope of the present invention.

The packaging unit 10 also includes a retainer means extending around the support base 36, assembly 68 of cylindrical objects 12 or roving packages 14 and lid 86 to maintain the integrity of the packaging unit 10 during movement thereof. As presently preferred, the retainer means comprises at least one packaging strap 136, tape or banding which can be formed of a material such as thermoplastic or thermosetting materials, cloth, or any suitable flexible material having sufficient strength to maintain the integrity of the assembled packaging unit 10. The packaging strap 136 can include reinforcements, such as fiber glass, for example.

Alternatively, the lid 86 and/or support base 36 can be banded by a compressive band or tape around the side walls thereof.

In the presently preferred embodiment shown in FIG. 1, the packaging unit 10 further comprises a generally rigid wall 138 positioned on a side 140 of the packaging unit 10 between the lid 86, the support base 36 and a corresponding pair of 142, 144 of corner protectors 126. The wall 138 can be positioned on any side of the packaging unit 10 desired.

The wall 138 can be formed of a generally rigid material such as those discussed above for the support base 36 or lid 86, and is preferably corrugated cardboard. The size of the wall 138 is preferably such that it extends between the support base 36 and lid 86 and to the edges 154 of the corner protectors 142. The wall 138 can generally be about 10 inches (25.4 cm) to about 100 inches (254 cm) wide and about 10 inches (25.4 cm) to about 100 inches (254 cm) long. Preferably, the wall 138 is about 28 inches (71.1 cm) wide and about 40 inches (101.6 cm) high.

As shown in FIG. 2, the wall 138 preferably includes a plurality of notches 146 for receivably accommodating therein the leading ends 28 from each column 70 of the assembly 68. The retainer means can extend around the bottom wall 38, an opposed pair of side walls 44 of the support base 36, the assembly 68 of cylindrical objects Or roving packages 14 and the lid 86 to maintain the integrity of the packaging unit 10 during movement.

In the presently preferred embodiment shown in FIG. 1, the packaging unit 10 further comprises a generally rigid platform 148 for supporting the bottom wall 38 of the support base 36. Generally, the platform 148 can be about 10 inches (25.4 cm) to about 100 inches (254 cm) wide and about 10 inches (25.4 cm) to about 100 inches (254 cm) long. The generally rigid platform 148 can be a conventional 38 inch by 52 inch (96.5 cm by 132.1 cm) wooden pallet which is well known to those of ordinary skill in the art. When the generally rigid platform 148 is used in the packaging unit 10, the material for the support base 36 need not be as strong or rigid as in the absence of the platform 148.

In the presently preferred embodiment, the retainer means extends around the platform 148, an opposed pair of side walls 44 of the support base 36, the assembly 68 of cylindrical objects or roving packages 14 and the lid 86.

The packaging unit 10 can be assembled in a variety of ways. For example, the support base 36 can be positioned upon the platform 148. Next, the outer sides 130 of the bottom ends 134 of two corner protectors 126 can be positioned adjacent the inner sides 60 of respective corners 54 of the support base 36 adjacent a common side wall 44. The plurality of objects 12 or roving packages 14 can be positioned in an array upon the support base 36. The remaining corner protectors 126 can be positioned adjacent the inner sides 60 of respective corners 54 of the support base 36 before packages 14 are positioned adjacent the remaining corner protectors.

After all of the packages 14 have been positioned within the assembly, the lower side 90 of the lid 86 can be positioned adjacent to the tom ends 22 of the top packages 80 such that the inner sides 112 of the corners 106 are adjacent the corresponding outer sides 13C of the top ends 132 of the corner protectors 126. The edge protectors 152 can be positioned along the edges of the lid 86 and the strap 136 wrapped around the platform 148, side walls 44 of the support base 36, and side walls 96 and top wall 88 of the lid 86, as shown in FIG. 1. Other methods for assembling the packaging unit 10 can be used, such as would be readily evident to one skilled in the art.

The packaging units of the present invention provide not only generally stable and secure packaging means for movement and shipment of a plurality of cylindrical objects, but have the added advantage of doing so using less packaging material than conventional packaging units. Also, the materials from which the packaging units of the present invention are formed can be recycled for additional cost savings, convenience and lessen waste.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, I claim:

1. A packaging unit, comprising:

(a) a generally rigid support base comprising a bottom wall having a plurality of edges; a plurality of side walls, each side wall extending upwardly from an edge; and a plurality of corners, each corner extending upwardly from an intersection of two edges;

(b) a plurality of generally cylindrical objects arranged in an assembly having at least one vertical column; each vertical column comprising a bottom object and a top object, each object having a top end, a bottom end and a side extending therebetween, the bottom end of each bottom object being supported by the support base, a portion of the side of selected bottom objects being adjacent to a portion of the support base selected from the group consisting of at least one of the side walls of the support base, at least one of the corners of the support base, and combinations thereof, wherein the assembly is free of walls between the cylindrical objects of the assembly, each corner of the base being generally arcuate about the objects of the adjacent vertical column;

(c) a generally rigid lid comprising a top wall having a lower side, an upper side opposite the lower side, and a plurality of edges; a plurality of side walls, each side wall extending downwardly from a corresponding edge of the top wall; and a plurality of corners, each corner extending downwardly from an intersection of two edges, each corner of the lid being generally arcuate about the objects of the adjacent vertical column, a portion of each corner of the support base being adjacent to a portion of a corresponding corner of the lid; the lower side of the lid being adjacent to the top end of each top object, a portion of the side of selected top objects being adjacent to a portion of the lid selected from the group consisting of at least one of the side walls of the lid, at least one of the corners of the lid, and combinations thereof, each side wall of the support base being spaced apart from each corresponding side wall of the lid; and (d) a retainer means extending around the support base, assembly of cylindrical objects and lid to maintain the integrity of the packaging unit during movement of the packaging unit.

2. The packaging unit according to claim 1, wherein each corner of the support base is connected to a corresponding corner of the lid.

3. A packaging unit, comprising:

(a) a generally rigid support base comprising a bottom wall having a plurality of edges; a plurality of side walls, each side wall extending upwardly from an edge; and a plurality of corners, each corner extending upwardly from an intersection of two edges and having an inner side and an outer side;

(b) a plurality of generally cylindrical objects arranged in an assembly having at least one vertical column; each vertical column comprising a bottom object and a top object, each object having a top end, a bottom end and a side extending therebetween, the bottom end of each bottom object being supported by the support base, a portion of the side of selected bottom objects being adjacent to a portion of the support base selected from the group consisting of at least one of the side walls of the support base, at least one of the corners of the support base, and combinations thereof, wherein the assembly is free of walls between the cylindrical objects of the assembly;

(c) a generally rigid lid comprising a top wall having a lower side, an upper side opposite the lower side, and a plurality of edges; a plurality of side walls, each side wall extending downwardly from a corresponding edge of the top wall; and a plurality of corners, each corner extending downwardly from an intersection of two edges, each corner having an inner side and an outer side; the lower side of the lid being adjacent to the top end of each top object, a portion of the side of selected top objects being adjacent to a portion of the lid selected from the group consisting of at least one of the side walls of the lid, at least one of the corners of the lid, and combinations thereof, each side wall of the support base being spaced apart from each corresponding side wall of the lid;

(d) a plurality of generally rigid corner protectors extending between each corner of the support base and each corresponding corner of the lid, each corner protector having an inner side, an outer side, a top end and a bottom end, each corner protector being generally arcuate about the objects of the adjacent vertical column, the outer side of the bottom end of each corner protector being adjacent to the inner side of the corresponding corner of the support base, the outer side of the top end of each corner protector being adjacent to the inner side of the corresponding corner of the lid, each corner protector being adjacent to at least one of the vertical columns of objects; and (e) a retainer means extending around the support base, assembly of cylindrical objects and lid to maintain the integrity of the packaging unit during movement of the packaging unit.

4. The packaging unit according to claim 3, wherein the side walls and corners of the support base form a rim around a periphery of the support base.

5. The packaging unit according to claim 3, wherein the corners of the support base are generally arcuate about the corresponding contacting portion of the side of the selected bottom objects.

6. The packaging unit according to claim 3, wherein at least one of the support base, the lid and the corner protectors is formed from a corrugated material.

7. The packaging unit according to claim 6, wherein the corrugated material is cardboard.

8. The packaging unit according to claim 3, wherein each cylindrical object is a wound package of strand material.

9. The packaging unit according to claim 8, wherein the strand material is fiber glass.

10. The packaging unit according to claim 8, wherein the strand material of each package is a roving which has a leading end and a trailing end, the trailing end of each package being connected to the leading end of the package immediately thereunder to permit automatic transfer between packages during withdrawal of the strand material from the packaging unit.

11. The packaging unit according to claim 8, wherein each wound package further comprises a protective material wrapped about at least a portion of the side and bottom end of the package.

12. The packaging unit according to claim 3, wherein the assembly has a single vertical column.

13. The packaging unit according to claim 3, wherein the assembly has a plurality of vertical columns.

14. The packaging unit according to claim 3, wherein the assembly further comprises at least one horizontal row.

15. The packaging unit according to claim 14, wherein the assembly has a single horizontal row.

16. The packaging unit according to claim 14, wherein the assembly has a plurality of horizontal rows.

17. The packaging unit according to claim 14, wherein objects other than the selected bottom objects are free from contact with the portion of the support base.

18. The packaging unit according to claim 3, wherein the side walls and corners of the lid form a rim around a periphery of the lid.

19. The packaging unit according to claim 3, wherein the corners of the lid are generally arcuate about the corresponding contacting portion of the side of the selected top objects.

20. The packaging unit according to claim 3, wherein the outer side of the bottom end of each corner protector is in facing engagement with the inner side of the corresponding corner of the support base.

21. The packaging unit according to claim 3, wherein the outer side of the top end of each corner protector is in facing engagement with the inner side of the corresponding corner of the lid.

22. The packaging unit according to claim 3, wherein the retainer means extends around the bottom wall and an opposed pair of side walls of the support base, the assembly of cylindrical objects and the lid to maintain the integrity of the packaging unit during movement of the packaging unit.

23. The packaging unit according to claim 3, further comprising a generally rigid wall positioned on a side of the packaging unit between the lid, the support base and a corresponding pair of corner protectors.

24. The packaging unit according to claim 23, wherein each cylindrical object is a wound package of strand material, the strand material of each package having a leading end and a trailing end, the trailing end of each of package being connected to the leading end of the package immediately thereunder to permit automatic transfer between packages during withdrawal of the strand material, the trailing end of the bottom package in each column being secured to the generally rigid wall or lid of the packaging unit.

25. The packaging unit according to claim 3, further comprising a generally rigid platform for supporting the bottom wall of the support base.

26. The packaging unit according to claim 25, wherein the retainer means extends around the platform, an opposed pair of side walls of the support base, the assembly of cylindrical objects and the lid to maintain the integrity of the packaging unit during shipping.

27. A packaging unit, comprising:

(a) a generally rigid support base comprising a bottom wall having a plurality of edges; a plurality of side walls, each side wall extending upwardly from an edge; and a plurality of corners, each corner extending upwardly from an intersection of two edges and having an inner side and an outer side;

(b) a plurality of generally cylindrical objects arranged in an assembly having at least one vertical column; each vertical column comprising a bottom object and a top object, each object having a top end, a bottom end and a side extending therebetween, the bottom end of each bottom object being supported by the support base, a portion of the side of selected bottom objects being adjacent to a portion of the support base selected from the group consisting of at least one of the side walls of the support base, at least one of the corners of the support base, and combinations thereof, wherein the assembly is free of walls between the cylindrical objects of the assembly;

(c) a generally rigid lid comprising a top wall having a lower side, an upper side opposite the lower side and a plurality of edges; a plurality of side walls, each side wall extending downwardly from a corresponding edge of the top wall; and a plurality of corners, each corner extending downwardly from an intersection of two edges; the lower side of the lid being adjacent to the top end of each top object, a portion of the side of selected top objects being adjacent to a portion of the lid selected from the group consisting of at least one of the side walls of the lid, at least one of the corners of the lid, and combinations thereof, each side wall of the support base being spaced apart from each corresponding side wall of the lid;

(d) a plurality of generally rigid corner protectors extending between each corner of the support base and each corresponding corner of the lid, each corner protector having a bottom end and a top end, each corner protector being generally arcuate about the objects of the adjacent vertical column, the bottom end of each corner protector being connected to the corresponding corner of the support base, the top end of each corner protector being connected to the corresponding corner of the lid, each corner protector being adjacent to at least one of the vertical columns of objects; and (e) a retainer means extending around the support base, assembly of cylindrical objects and lid to maintain the integrity of the packaging unit during movement of the packaging unit.

28. A packaging unit, comprising:

(a) a generally rigid support base comprising a bottom wall having a plurality of edges; a plurality of side walls, each side wall extending upwardly from an edge; and a plurality of corners, each corner extending upwardly from an intersection of two edges;

(b) a plurality of generally cylindrical objects arranged in an assembly having at least one horizontal row; each horizontal row comprising a bottom object, each object having a top end, a bottom end and a side extending therebetween, the bottom end of each bottom object being supported by the support base, each corner of the base being generally arcuate about an object of the adjacent horizontal row, a portion of the side of selected bottom objects being adjacent to a portion of the support base selected from the group consisting of at least one of the side walls of the support base, at least one of the corners of the support base, and combinations thereof, wherein the assembly is free of walls between the cylindrical objects of the assembly;

(c) a generally rigid lid comprising a top wall having a lower side, an upper side opposite the lower side, and a plurality of edges; a plurality of side walls, each side wall extending downwardly from a corresponding edge of the top wall; and a plurality of corners, each corner extending downwardly from an intersection of two edges, each corner of the lid being generally arcuate about an object of the adjacent horizontal row, a portion of each corner of the support base being adjacent to a portion of a corresponding corner of the lid; the lower side of the lid being adjacent to the top end of selected objects, a portion of the side of the selected objects being adjacent to a portion of the lid selected from the group consisting of at least one of the side walls of the lid, at least one of the corners of the lid, and combinations thereof, each side wall of the support base being spaced apart from each corresponding side wall of the lid; and (d) a retainer means extending around the support base, assembly of cylindrical objects and lid to maintain the integrity of the packaging unit during movement of the packaging unit.

29. A packaging unit, comprising:

(a) a generally rigid support base comprising a bottom wall having a plurality of edges; a plurality of side walls, each side wall extending upwardly from an edge; and a plurality of corners, each corner extending upwardly from an intersection of two edges and having an inner side and an outer side;

(b) a plurality of generally cylindrical objects arranged in an assembly having at least one horizontal row; each horizontal row comprising a bottom object, each object having a top end, a bottom end and a side extending therebetween, the bottom end of each bottom object being supported by the support base, a portion of the side of selected bottom objects being adjacent to a portion of the support base selected from the group consisting of at least one of the side walls of the support base, at least one of the corners of the support base, and combinations thereof, wherein the assembly is free of walls between the cylindrical objects of the assembly;

(c) a generally rigid lid comprising a top wall having a lower side, an upper side opposite the lower side, and a plurality of edges; a plurality of side walls, each side wall extending downwardly from a corresponding edge of the top wall; and a plurality of corners, each corner extending downwardly from an intersection of two edges, each corner having an inner side and an outer side; the lower side of the lid being adjacent to the top end of selected objects, a portion of the side of the selected objects being adjacent to a portion of the lid selected from the group consisting of at least one of the side walls of the lid, at least one of the corners of the lid, and combinations thereof, each side wall of the support base being spaced apart from each corresponding side wall of the lid;

(d) a plurality of generally rigid corner protectors extending between each corner of the support base and each corresponding corner of the lid, each corner protector having an inner side, an outer side, a top end and a bottom end, each corner protector being generally arcuate about an object of the adjacent horizontal row, the outer side of the bottom end of each corner protector being adjacent to the inner side of the corresponding corner of the support base, the outer side of the top end of each corner protector being adjacent to the inner side of the corresponding corner of the lid, each corner protector being adjacent to at least one object of the horizontal row; and (e) a retainer means extending around the support base, assembly of cylindrical objects and lid to maintain the integrity of the packaging unit during movement of the packaging unit.

* * * * *

UNITED STATES PATENT AND TRADEMARK OFFICE

CERTIFICATE OF CORRECTION

PATENT NO. : 5,551,563

DATED : September 3, 1996

INVENTOR(S) : Lesley M. Allen

It is certified that error appears in the above-identified patent and that said Letters Patent are hereby corrected as shown below:

Under "References Cited, U.S. Patent Documents", add patent number "4,848,651".

"4,848,651 7-1989 Hartness 229 125.33--

Under "References Cited", add a section for "Foreign Patent Documents" and list the following patent numbers:

| | | |
|---|---|---|
| **1494456** | 12/1977 | Great Britain |
| **1118722** | 07/1968 | Great Britain |
| **0178717 A2** | 04/1986 | EPO |
| **2440666 A1** | 03/1976 | Germany |
| **2.200.823** | 04/1974 | France |

Line 17 of the Abstract, delete the number "14" from the phrase "support 14 base", so that it reads "support base"

Signed and Sealed this

Twenty-third Day of September, 1997

Bruce Lehman

*Attest:*

BRUCE LEHMAN

*Attesting Officer*

*Commissioner of Patents and Trademarks*